US007314137B2

(12) United States Patent
Rabiea

(10) Patent No.: US 7,314,137 B2
(45) Date of Patent: Jan. 1, 2008

(54) BAG DISPENSER WITH POUCH

(75) Inventor: Jeffrey Rabiea, Lattington, NY (US)

(73) Assignee: Redi-Bag USA, New Hyde Park, NY (US)

( * ) Notice: Subject to any disclaimer, the term of this patent is extended or adjusted under 35 U.S.C. 154(b) by 242 days.

(21) Appl. No.: 11/195,127

(22) Filed: Aug. 2, 2005

(65) Prior Publication Data

US 2007/0031069 A1 Feb. 8, 2007

(51) Int. Cl.

| | |
|---|---|
| ***B65D 1/34*** | (2006.01) |
| ***A47F 5/02*** | (2006.01) |
| ***A47F 5/08*** | (2006.01) |
| ***B65B 67/04*** | (2006.01) |

(52) U.S. Cl. ..... 206/554; 211/59.1; 211/163; 248/100

(58) Field of Classification Search ..... 206/554, 206/459.1, 459.5, 494, 806, 730–735; 383/37; 211/12, 50, 59.1, 163; 248/99–101; 221/45–46, 221/63–65

See application file for complete search history.

(56) References Cited

U.S. PATENT DOCUMENTS

| | | | | |
|---|---|---|---|---|
| 3,089,586 | A * | 5/1963 | Cole | 206/494 |
| 3,162,305 | A * | 12/1964 | Schoppa, Jr. | 206/554 |
| 3,281,056 | A * | 10/1966 | Kugler | 206/554 |
| 3,306,492 | A * | 2/1967 | Kugler | 221/63 |
| 3,608,712 | A * | 9/1971 | Savoie | 206/554 |
| 3,696,991 | A * | 10/1972 | Willis | 383/37 |
| RE32,443 | E * | 6/1987 | Kalal | 206/459.1 |
| 6,505,750 | B1 * | 1/2003 | Nguyen | 211/163 |
| 6,651,832 | B1 * | 11/2003 | Nguyen | 211/163 |

* cited by examiner

*Primary Examiner*—Bryon P Gehman
(74) *Attorney, Agent, or Firm*—Robert L. Epstein; Epstein Drangel Bazerman & James, LLP

(57) ABSTRACT

The dispenser includes a header. A plurality of bags is removably attached to the header. Each of the bags has a bottom section. The dispenser also includes a pouch. The pouch has a rear wall and an opening. A back sheet is integral with the rear wall of the pouch and extends to the header for attaching the pouch and the header such that the bottom sections of the bags may extend through the pouch opening and within the pouch. In this manner, bags that are detached from the header, but are not removed from the dispenser, remain in the pouch and are available for use by the next customer.

20 Claims, 4 Drawing Sheets

BAG DISPENSER WITH POUCH

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to plastic bags of the type used in grocery stores and the like to contain food items such as produce and more particularly to a dispenser for such bags that includes an integral pouch.

2. Description of Prior Art Including Information Disclosed under 37 CFR 1.97 and 1.98.

Bags for containing food products, such as produce, have been known and widely used in grocery and other stores for many years. Such bags are commonly made of two sheets of thin, flexible plastic material, such as polyethylene or polypropylene, heat sealed together at the bottom and the side edges. An opening at the top of the bag permits produce to be introduced into the bag.

The bags are either supplied in rolls, with the bags connected to each other end to end across a line of perforations, or in side-by-side relation attached to an elongated plastic header by a perforated section. The perforations allow easy removal of the bags from the roll or header by customers. The customers place the produce they wish to purchase in the removed bag for weighing by the cashier and transport from the store. After insertion of the product into the bag, the top of the bag may be closed with a twist tie or similar fastening device, or may simply be knotted to close the bag.

The problem often encountered with this type of bag is that customers often remove more bags than they need and will then discard the unwanted bags. The unwanted bags commonly end upon on the floor of the produce department and therefore cannot be used. It is estimated that 10% to 15% of all grocery bags dispensed in this fashion are unused and discarded in this manner. Although the individual bags themselves are quite inexpensive, the number of bags sold is very high and the cost of the unusable bags to the store owner is substantial. Further, the unwanted bags on the store floor are unsightly and create a safety hazard for customers. A great deal of the time and effort is required to continually remove the unwanted bags from the floor, creating an additional expense for the store owner.

It is therefore a prime object of the present invention to provide a bag dispenser with an integral pouch that substantially reduces the number of unused bags.

It is another object of the present invention to provide a bag dispenser with an integral pouch that substantially reduces the number of bags that end up on the floor of the store.

It is another object of the present invention to provide a bag dispenser with an integral pouch that is capable of displaying graphic and/or text material for decorative or promotional purposes.

It is another object of the present invention to provide a bag dispenser with an integral pouch that is simple in structure, inexpensive to produce and easy for a customer to use.

BRIEF SUMMARY OF THE INVENTION

In accordance with one aspect of the present invention, a bag dispenser is provided. The bag dispenser includes a header. A bag is removably attached to the header. A pouch is provided having an opening. Means attach the pouch to the header such that at least a portion of the bag may be received through the opening and within the pouch.

Preferably, a surface of the pouch is adapted to be imprinted with graphics and/or text for decorative or advertising purposes. Alternately, a sheet with an imprinted surface can be provided. Means are provided to retain the sheet within the pouch, with the imprinted surface visible from the exterior of the pouch.

The header is elongated and has a central opening. First and second pairs of openings are spaced from the central opening.

The attaching means is preferably integral with the pouch and is connected to the header. The pouch includes a rear wall. The rear wall of the pouch forms a part of the attaching means.

The bag and the pouch are preferably formed of the same plastic sheet material. However, the plastic sheet material from which the pouch is formed is thicker than the plastic sheet material from which the bag is formed. The plastic sheet material is preferably flexible and light transmissive.

In accordance with another aspect of the present invention, a bag dispenser is provided. The dispenser includes a header. A plurality of bags is removably attached to the header. Each of the bags has a bottom section. The dispenser also includes a pouch. The pouch has a rear wall and an opening. Means extend between the rear wall of the pouch and the header for attaching the pouch and the header such that the bottom sections of the bags may extend through the opening and within the pouch.

Preferably, a surface of the pouch is adapted to be imprinted with graphics and/or text for decorative or advertising purposes. Alternately, a sheet with an imprinted surface is provided. Means are provided to retain the sheet within the pouch, with the imprinted surface visible from the exterior of the pouch.

The header is elongated and has a central opening. First and second pairs of openings are spaced from the central opening.

Preferably, the attaching means is integral with the pouch and is connected to the header. The pouch has a rear wall. The rear wall of the pouch preferably constitutes a part of the attaching means.

Preferably, the bag and the pouch are made of the same plastic sheet material. The sheet material from which the pouch is formed is thicker than the plastic sheet material from which the bags are formed. The plastic sheet material is preferably flexible and light transmissive.

BRIEF DESCRIPTION OF THE SEVERAL VIEWS OF DRAWINGS

To these and to such other objects that may hereinafter appears, the present invention relates to a bag dispenser with integral pouch as described in detail in the following specification and recited in the annexed claims, taken together with the accompanying drawings, in which like numerals refer to like parts and in which:

DETAILED DESCRIPTION OF THE INVENTION

Figure 1:
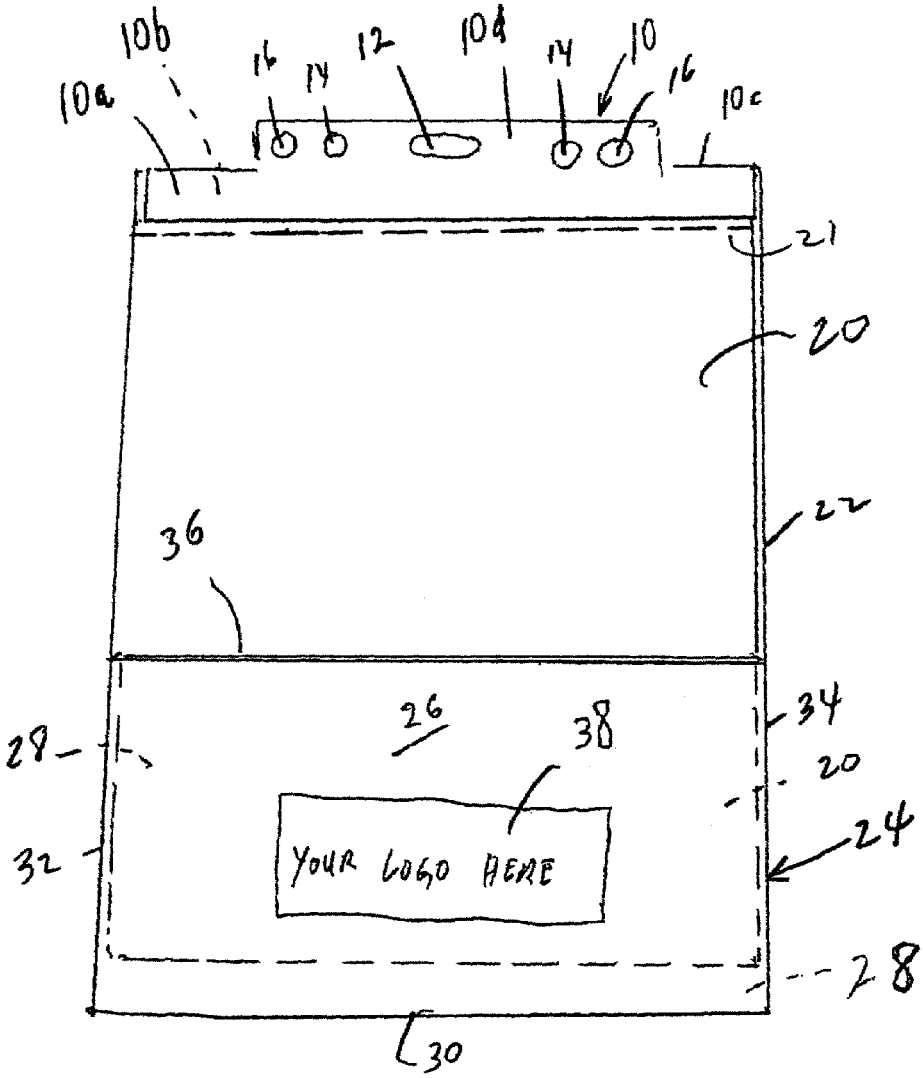
FIG. 1 is an isometric view of the bag dispenser of the present invention.

As seen in the drawings, the bag dispenser of the present invention includes an elongated header, generally designated 10, made of relatively sturdy, flexible plastic. Header 10 includes a front wall 10*a* and a rear wall 10*b* attached together at edge 10*c* so as to form a recess within which the top portions of bags 20 are retain retained. A portion 10*d* of the header extends upwardly beyond edge 10*c*. Header portion 10*d* has an oval shaped central opening 12 and first and second pairs 14, 16 of spaced circular openings located on either side of the central opening. Openings 12, 14 and 16 are adapted to accept rods 18, only one of which are shown, which can be provided in a variety of different shapes and configurations, to suspend the bag dispenser.

One or more bags 20 (only two are shown for simplicity) are removably attached to header 10. The top sections of the bags are retained between the front 10*a* and rear 10*b* walls of the header. The bags are connected to the top sections by a perforation line 21 that extends across the width of the bags immediately below the header and can be easily removed from the header by tearing along line 21, as is conventional.

The walls of bags 20 are made of two sheets of thin, flexible, light transmissive (transparent or translucent) plastic material. The sheets are heat sealed together along the bottom and sides of the bag, as is conventional.

Also suspended from header 10, in the same manner as bags 20, is a back sheet 22, preferably made of the same plastic sheet material as the bag walls, but considerably thicker stock than the walls of the bags, to give the back considerably more strength than the bag walls.

Located at the bottom of sheet 22 is a pouch, generally designated 24. Pouch 24 consists of a front wall 26 and a rear wall 28. Walls 26 and 28 are heat sealed to each other along bottom 30 and sides 32, 34, leaving an opening 36 facing the header.

Back sheet 22 constitutes a means for attaching pouch 24 and header 10 such that the bottom section of each of the bags 20 may be extend through opening 36 and within pouch 24. Preferably, rear wall 28 of the pouch is integral with back sheet 22 so that the pouch and the attaching means can be manufactured together.

Figure 2:
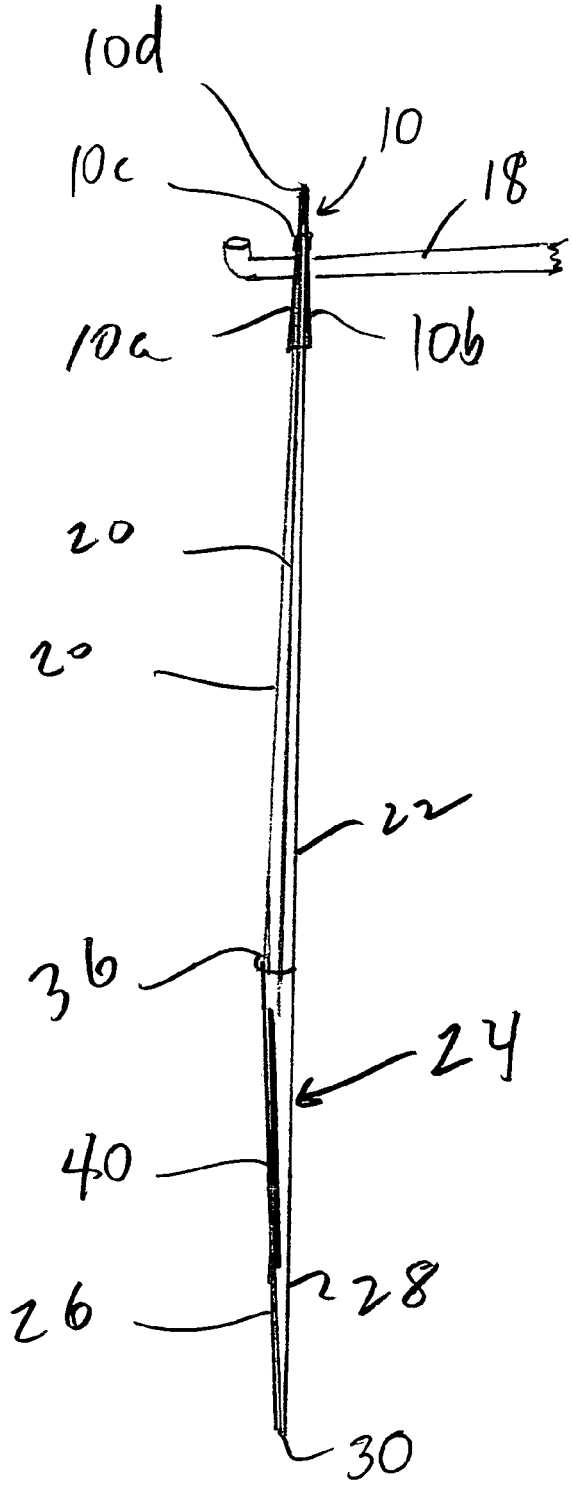
FIG. 2 is a side view of the bag dispenser with an advertising insert.
Figure 3:
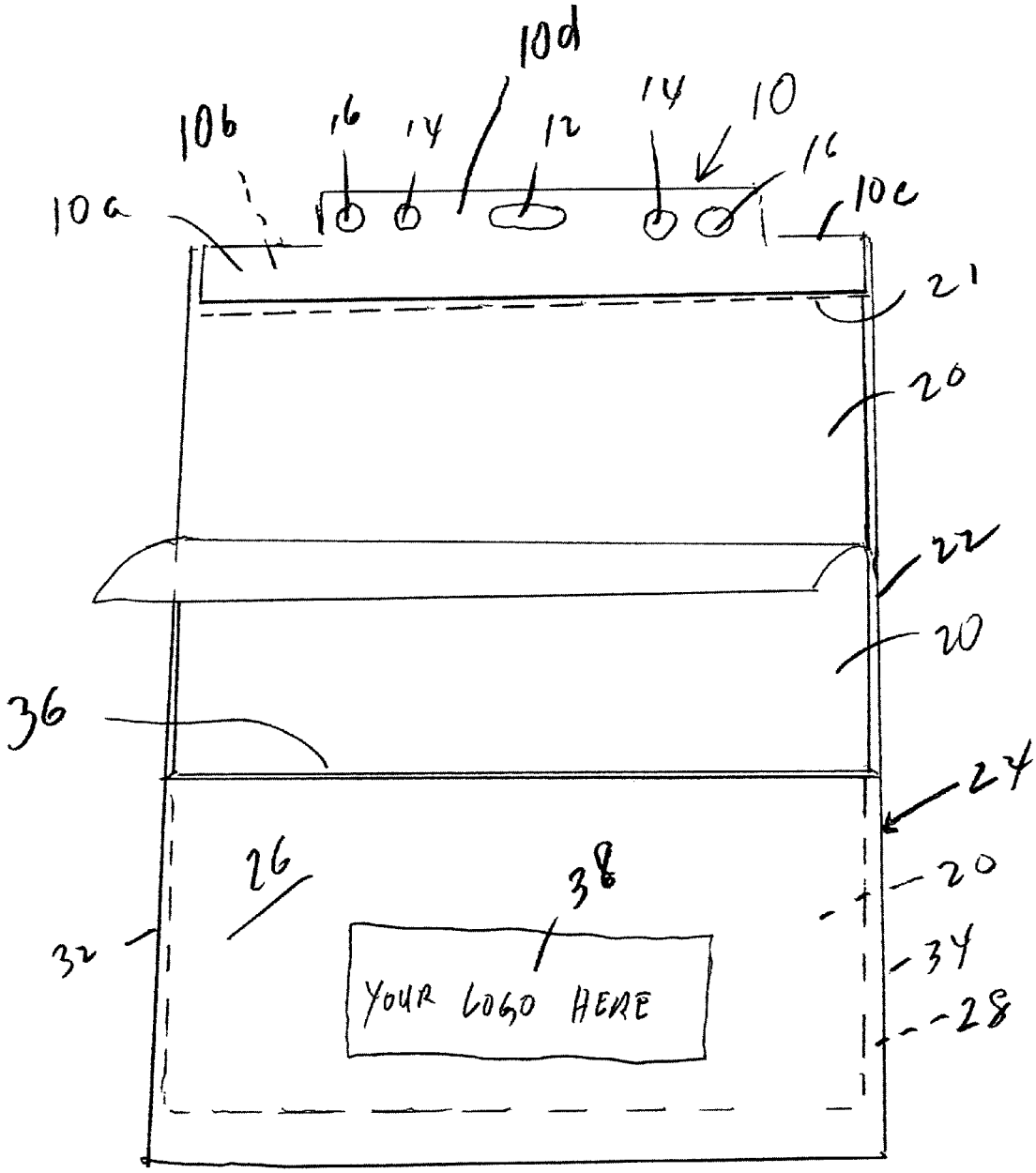
FIG. 3 is an isometric view of the bag dispenser of FIG. 1 showing a bag immediately after it has been detached from the header.
Figure 4:
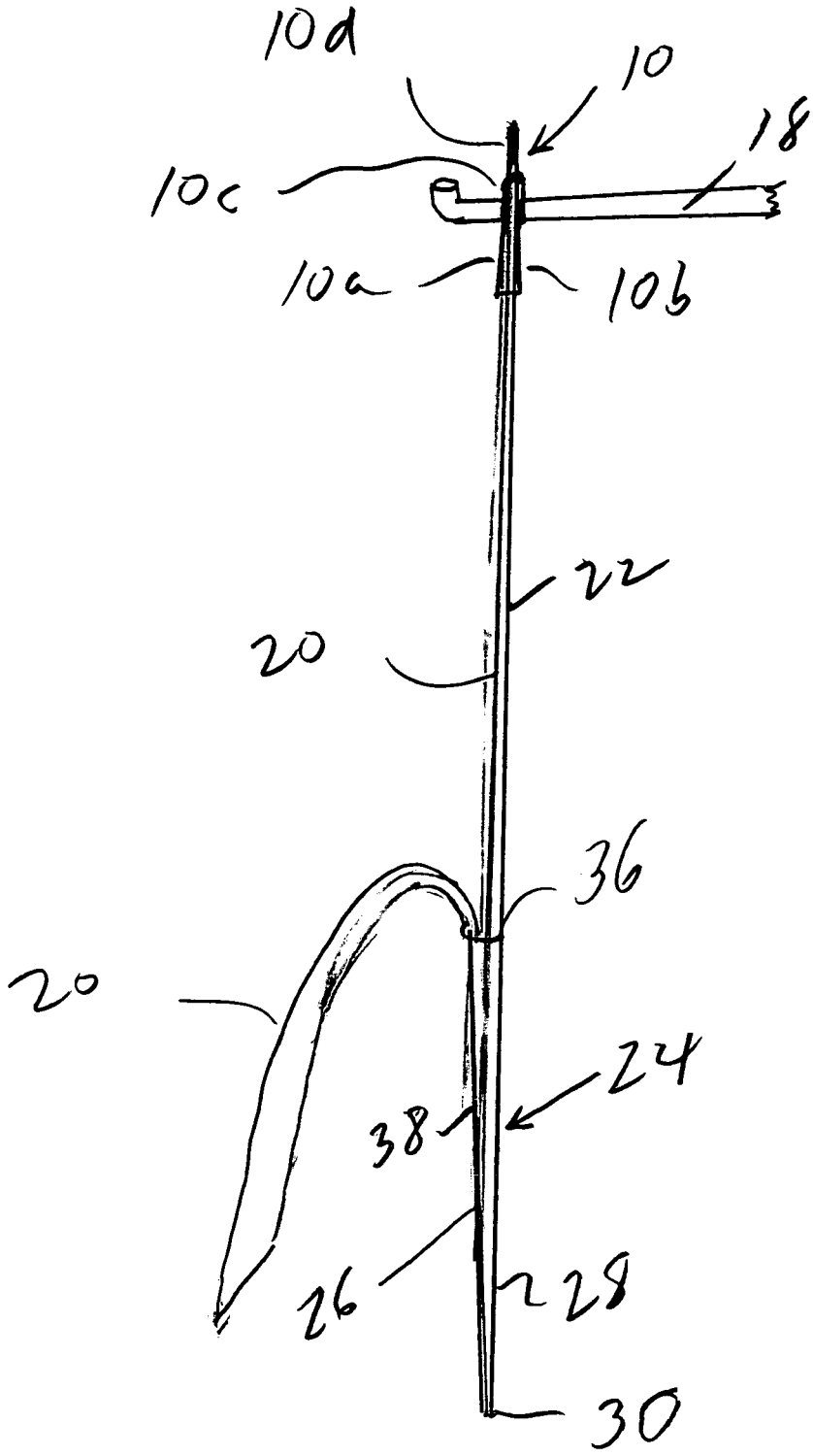
FIG. 4 is a side view of the dispenser of FIG. 1 showing a bag detached from the header.

A surface 38 of the front wall 26 of the pouch is adapted to be imprinted with graphics and/or text for decorative or promotional purposes, as seen in FIGS. 1, 3 and 4. Alternatively, a sheet 40 of plastic or cardboard may be imprinted and inserted behind front wall 26 such that the imprinted surface is visible from the pouch exterior, as illustrated in FIG. 2. Means, such as a layer of adhesive or tape, may be used for retaining sheet 40 in place within the pouch.

As illustrated in FIGS. 1 and 2, the bottom portions of the bags 20 suspended from header 10 are normally situated within pouch 24. The bags are removed from the dispenser, one at a time, by tearing the top of the bag from the leader along the perforation line 21 just beneath the header and then moving the top of the bag away from the header such that the bottom of the bag is withdrawn from the pouch.

If the customer inadvertently tears more bags at a time from the header than are needed, but only removes the some of the detached bags, leaving an unattached bag behind, the unattached bag that has not removed from the dispenser will remain on the dispenser, with its bottom portion in the pouch, as is illustrated in FIGS. 3 and 4, which respectively show the detached but remaining bag immediately after detachment, and after the top of the bag has proceeded to its final position under the influence of gravity. The pouch prevents the detached bag from falling on the floor and becoming soiled and hence unusable. The detached bag remains useable and available for use by the next customer who will simply remove it from the pouch. This system dramatically reduces the number of wasted bags as well as the quantity of unused bags falling onto the floor.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A bag dispenser comprising: a header, said header comprising a front wall and a rear wall attached together to form a recess; a bag, said bag comprising a perforation line dividing the bag into a first section and a second section, said first section being situated within said header recess and retained between said front wall and said rear wall of said header; a pouch, said pouch comprising a front wall having a bottom edge, side edges and a top edge, and a rear wall having a bottom edge and side edges, said bottom edge and said side edges of said front wall and said bottom edge and said side edges of said rear wall, respectively, being joined together to form said pouch, said top edge of said front wall being unattached so as to define an opening for said pouch spaced from said header; and means for attaching said pouch to said header such that at least a portion of said second section of said bag may extend through said pouch opening and within said pouch.

2. The dispenser of claim 1 further comprising a surface of said pouch adapted to be imprinted.

3. The dispenser of claim 1 further comprising a sheet with an imprinted surface and means for retaining said sheet within said pouch, with said imprinted surface visible from the exterior of said pouch.

4. The dispenser of claim 1 wherein said header is elongated and comprises a central opening and first and second pairs of openings spaced from said central opening.

5. The dispenser of claim 1 wherein said attaching means is integral with said pouch and connected to said header.

6. The dispenser of claim 1 wherein said pouch comprises a rear wall and wherein said rear wall of said pouch comprises said attaching means.

7. The dispenser of claim 1 wherein said bag and said pouch comprise the same plastic sheet material.

8. The dispenser of claim 7 wherein said plastic sheet material from which the pouch is formed is thicker than said plastic sheet material from which the bag is formed.

9. The dispenser of claim 7 wherein said plastic sheet material is flexible.

10. The dispenser of claim 7 wherein said plastic sheet material is light transmissive.

11. A bag dispenser comprising: a header, said header comprising a front wall and rear wall attached together to form a recess; a plurality of bags, each of said bags comprising a perforation line dividing the bag into a first section and a second section, said first section being situated within said header recess and retained between said front wall and said rear wall of said header; a pouch, said pouch comprising a front wall having a bottom edge, side edges and a top edge, and a rear wall having a bottom edge and side edges, said bottom edge and said side edges of said front wall and said bottom edge and said side edges of said rear wall, respectively, being joined together to form said pouch, said top edge of said front wall being unattached so as to define an opening for said pouch spaced from said header; and means for attaching said pouch to said header such that at least a portion of said second sections of each of said bags may extend through said pouch opening and within said pouch.

12. The dispenser of claim 11 further comprising a surface of said pouch adapted to be imprinted.

13. The dispenser of claim 11 further comprising a sheet with an imprinted surface and means for retaining said sheet within said pouch with said imprinted surface visible from the exterior of said pouch.

14. The dispenser of claim 11 wherein said header is elongated and comprises a central opening and first and second pairs of openings spaced from said central opening.

15. The dispenser of claim 11 wherein said attaching means is integral with said rear wall of said pouch.

16. The dispenser of claim 11 wherein said rear wall of said pouch comprises said attaching means.

17. The dispenser of claim 11 wherein said bags and said pouch comprise the same plastic sheet material.

18. The dispenser of claim 17 wherein said plastic sheet material from which said pouch is formed is thicker than said plastic sheet material from which said bags are formed.

19. The dispenser of claim 17 wherein said plastic sheet material is flexible.

20. The dispenser of claim 17 wherein said plastic sheet material is light transmissive.

* * * * *